US008839873B2

(12) United States Patent
Johnson et al.

(10) Patent No.: US 8,839,873 B2
(45) Date of Patent: Sep. 23, 2014

(54) ISOLATION OF ZONES FOR FRACTURING USING REMOVABLE PLUGS

(75) Inventors: Charles C. Johnson, League City, TX (US); Michael H. Johnson, Katy, TX (US); Maria M. O'Connell, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 637 days.

(21) Appl. No.: 12/980,798

(22) Filed: Dec. 29, 2010

(65) Prior Publication Data

US 2012/0168180 A1 Jul. 5, 2012

(51) Int. Cl.
*E21B 33/124* (2006.01)
*E21B 43/119* (2006.01)
*E21B 33/12* (2006.01)

(52) U.S. Cl.
CPC ..... *E21B 33/1208* (2013.01); *E21B 33/124* (2013.01); *E21B 43/119* (2013.01)
USPC ..... 166/386; 166/297; 166/55; 166/192

(58) Field of Classification Search
USPC ..... 166/386, 374, 297, 55, 192, 195, 153, 166/154, 156
See application file for complete search history.

(56) References Cited

U.S. PATENT DOCUMENTS 2,180,605 A * 11/1939 Otis ..... 166/205
2,986,214 A * 5/1961 Wiseman, Jr. et al. ..... 175/4.52
4,043,410 A 8/1977 Bennett et al.
4,044,827 A * 8/1977 Kerzee et al. ..... 166/133
4,637,468 A 1/1987 Derrick
4,658,896 A 4/1987 Milam
4,949,788 A 8/1990 Szarka et al.
5,265,678 A 11/1993 Grundmann
5,366,014 A * 11/1994 George ..... 166/297
5,368,098 A * 11/1994 Blizzard et al. ..... 166/100
5,425,424 A 6/1995 Reinhardt et al.
5,669,448 A * 9/1997 Minthorn et al. ..... 166/308.1
5,685,372 A 11/1997 Gano
5,704,426 A * 1/1998 Rytlewski et al. ..... 166/297
6,098,716 A * 8/2000 Hromas et al. ..... 166/377
6,145,593 A 11/2000 Hennig
6,263,968 B1 7/2001 Freeman et al.
6,460,619 B1 * 10/2002 Braithwaite et al. ..... 166/259
6,568,470 B2 5/2003 Goodson, Jr. et al.
6,571,871 B2 6/2003 Lauritzen et al.
6,779,600 B2 8/2004 King et al.
6,896,061 B2 * 5/2005 Hriscu et al. ..... 166/313
6,926,089 B2 8/2005 Goodson, Jr. et al.
7,013,979 B2 3/2006 Richard
7,387,165 B2 6/2008 Lopez de Cardenas et al.
7,493,956 B2 2/2009 Shaw et al.

(Continued)

*Primary Examiner* — Blake Michener
(74) *Attorney, Agent, or Firm* — Steve Rosenblatt

(57) ABSTRACT

An interval can be divided into zones by inserting a series of plugs that register with specific profiles at predetermined intervals along a section of pipe. Each plug supports a releasable perforating gun that can release from the plug and perforate an interval for treatment such as fracturing or acidizing. A subsequent plug then isolates the just treated zone and the process is repeated working up toward the surface. When the full interval is treated the plugs can then be removed by making their cores disappear using a reaction or dissolving techniques. Mechanical alternative that push all the plugs to hole bottom or that retrieve them together or individually are possible alternative techniques for removal of the plugs from the treated interval before production is initiated.

16 Claims, 3 Drawing Sheets

(56) References Cited

U.S. PATENT DOCUMENTS

| | | | | |
|---|---|---|---|---|
| 7,533,721 | B2 | 5/2009 | Sorhus | |
| 7,591,312 | B2 | 9/2009 | Johnson et al. | |
| 7,686,082 | B2 | 3/2010 | Marsh | |
| 7,775,758 | B2 | 8/2010 | Legare | |
| 8,037,934 | B2 * | 10/2011 | Strickland | 166/250.01 |
| 8,127,846 | B2 * | 3/2012 | Hill et al. | 166/285 |
| 8,505,632 | B2 * | 8/2013 | Guerrero et al. | 166/373 |
| 2002/0092650 | A1 * | 7/2002 | Tolman et al. | 166/298 |
| 2002/0148611 | A1 * | 10/2002 | Williger et al. | 166/297 |
| 2003/0188869 | A1 * | 10/2003 | Tinker | 166/301 |
| 2005/0023004 | A1 | 2/2005 | King et al. | |
| 2005/0241824 | A1 * | 11/2005 | Burris et al. | 166/255.1 |
| 2006/0144590 | A1 | 7/2006 | Lopez de Cardenas et al. | |
| 2006/0201675 | A1 * | 9/2006 | Ferguson et al. | 166/298 |
| 2007/0221373 | A1 * | 9/2007 | Murray | 166/192 |
| 2008/0011479 | A1 * | 1/2008 | Horton | 166/285 |
| 2013/0138254 | A1 * | 5/2013 | Seals et al. | 700/282 |

* cited by examiner

ISOLATION OF ZONES FOR FRACTURING USING REMOVABLE PLUGS

FIELD OF THE INVENTION

The field of this invention is zone isolation for treatment and more particularly where the barriers are temporary and do not need to be milled out at the conclusion of the treatment but instead are otherwise removed.

BACKGROUND OF THE INVENTION

In the past one system that allowed fracturing an interval included a series of external isolators such as open hole packers and a plurality of sliding sleeve valves. These valves could be operated with dropped balls of different sizes that would get progressively larger as sliding sleeve valves closer to the surface had to be operated by larger balls later in the procedure. Because of the size of the bottom hole assembly, there were only so many discrete ball sizes that could be used. The more zones that needed treatment in a given interval, the fewer the openings for treatment fluid that could be used in each zone. One example relevant to this concept is U.S. Pat. No. 7,591,312.

Some operators want a more even distribution of fracturing or acid treating fluids in each isolated zone in an interval. In the past one technique has been to install a plug, perforate the zone/section, and treat the zone just perforated. The next plug is installed to isolate the zone just treated and another gun is fired in the adjacent zone and the process is repeated until the entire interval is treated. At the end of the treatment all the plugs have to be milled out. The plugs are made from easily milled materials to expedite this process. This process is time consuming and therefore expensive and it generates a lot of cuttings that have to be removed from the borehole.

The present invention addresses an alternative technique to milling out all the plugs that were used to isolate intervals with an option to remove the plugs by making them disappear or by physically forcing them to hole bottom or grabbing them and removing them from the wellbore.

The concept of using tubular barriers in general that can disappear, usually with a chemical reaction, or by dissolving or using magnetic fields are illustrated in the following references: U.S. Pat. Nos. 6,568,470; 6,926,089 (FIGS. 4 and 5); U.S. Pat. Nos. 6,779,600; 6,145,593; 7,533,721; 7,493,956 and 5,425,424. Also of interest is US Publication 2005/0023004.

Those skilled in the art will better appreciate the details of the invention from a review of the detailed description of the preferred embodiment and the associated drawings while appreciating that the full scope of the invention is to be found in the appended claims.

SUMMARY OF THE INVENTION

An interval can be divided into zones by inserting a series of plugs that register with specific profiles at predetermined intervals along a section of pipe. Each plug supports a releasable perforating gun that can release from the plug and perforate an interval for treatment such as fracturing or acidizing. A subsequent plug then isolates the just treated zone and the process is repeated working up toward the surface. When the full interval is treated the plugs can then be removed by making the blocking member in the cores partly or totally disappear using a reaction or dissolving techniques. If there is a partial elimination the residue can be allowed to fall further in the hole or circulation can bring the residue from the borehole. Mechanical alternative that push all the plugs to hole bottom or that retrieve them together or individually are possible alternative techniques for removal of the plugs from the treated interval before production is initiated.

DETAILED DESCRIPTION OF THE PREFERRED EMBODIMENT

Figure 1:
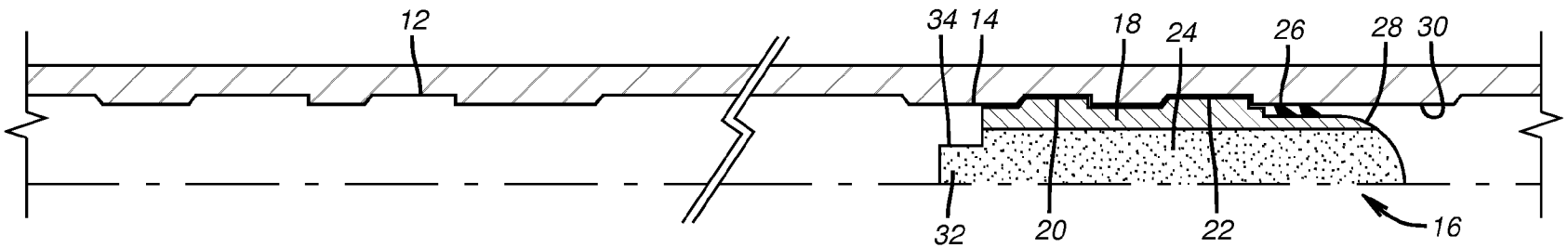
FIG. 1 is a section view of multiple landing profiles with a disappearing plug shown on one of the profiles.

FIG. 1 shows a casing or liner 10 with distinct profiles 12 and 14. Those skilled in the art will appreciate that more than two profiles can be used for covering an interval that is to be subdivided into a plurality of zones. Each profile used is unique so that a plug assembly 16 will only latch in one specific location in the casing or liner 10.

In one embodiment the plug assembly 16 can have a metallic housing 18 that has projections 20 and 22 to engage a given profile such as 14 as shown in FIG. 1. A core 24 is surrounded by housing 18. A seal assembly 26 which can be a wiper assembly of parallel fins is disposed on the lower end 28 of the plug assembly 16. Seal assembly 26 seals against the inner wall 30 of the casing or liner 10. At the upper end 32 of the plug assembly 16 is a portion of a disconnect 34 that supports a gun 36 shown in FIG. 4. As seen in FIG. 4 the assembly from bottom to top is a plug assembly 16, a disconnect assembly 34 and a perforating gun 36. A portion of the disconnect 34 and the gun 36 are eliminated from FIGS. 1 and 3 for clarity while the supporting string 35 is shown.

Figure 3:
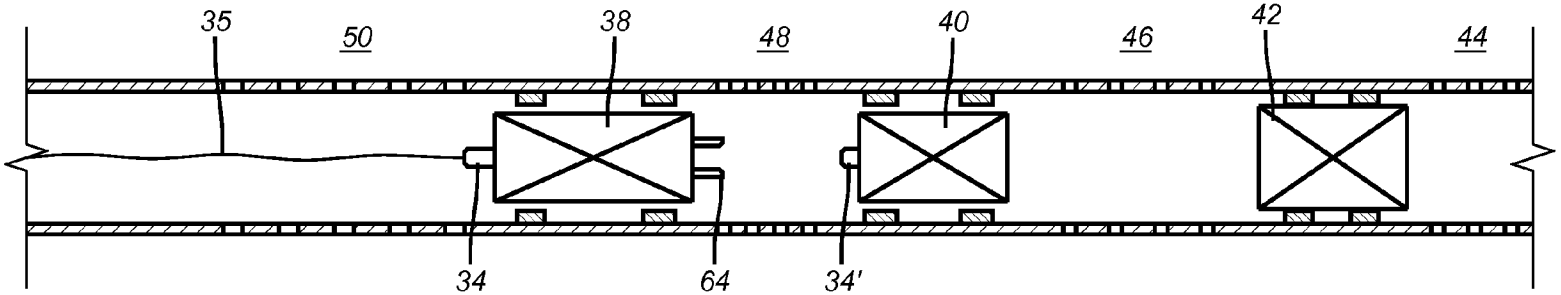
FIG. 3 shows a series of plugs schematically represented in their landed positions after several zones have been treated.
Figure 4:
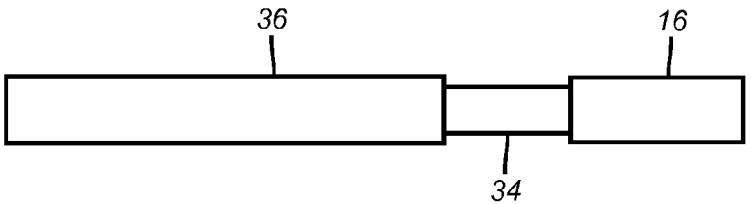
FIG. 4 is a typical assembly that goes with each plug when landed so that the zone above it can be perforated and the gun subsequently removed.

FIG. 3 illustrates 3 plug assemblies 16 landed in discrete profiles 38, 40 and 42 that are schematically illustrated as being differently dimensioned in keeping with the concept that each of the illustrated plugs can be latched at one discrete location. In this FIG. the zones 44, 46 and 48 have already been treated and the zone 50 is perforated and is ready to be treated.

Figure 2:
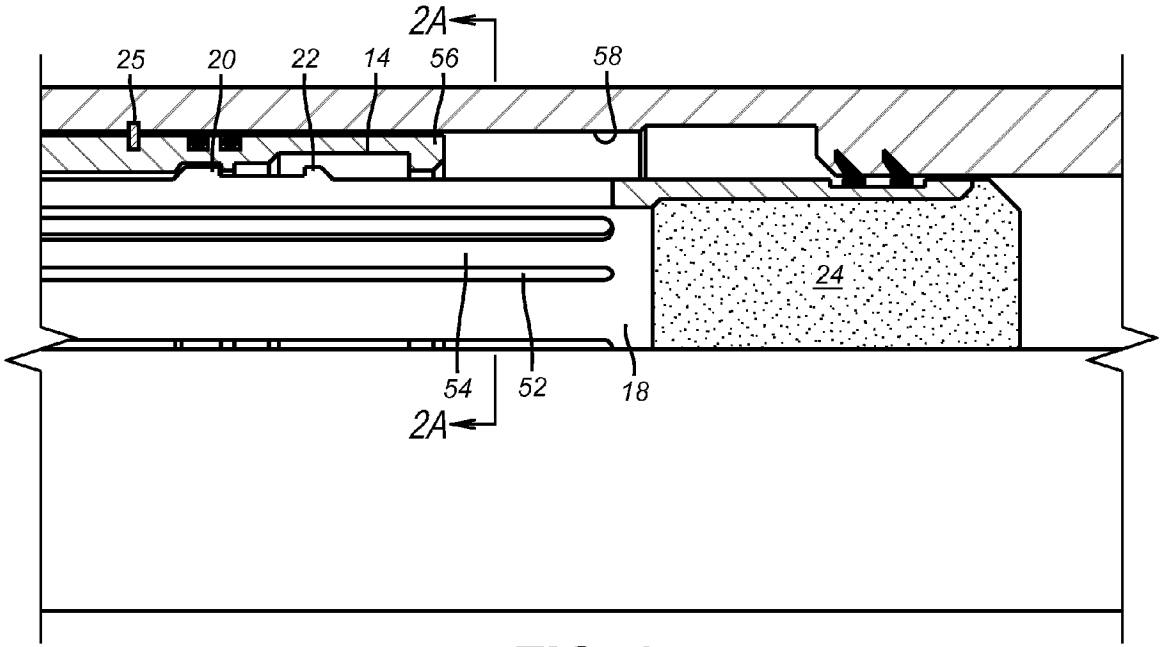
FIG. 2 is a detailed view of the plug of FIG. 1 latched into a specific profile or mechanically retained in the casing or liner.
Figure 2A:
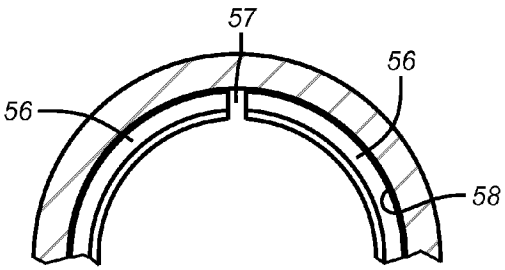
FIG. 2*a* is an end view along lines 2*a*-2*a* of FIG. 2.

FIG. 2 illustrates a more detailed view of the plug assembly 16 that has a core 24 that can be removed with exposure to fluid such as by chemical reaction or dissolving or thermal degradation or other change in strength or physical properties. The housing 18 has slots 52 that define flexible fingers 54 on which the latching shapes 20 and 22 are located. The profile 14 is provided on a sleeve 56 supported in a recess 58 in the casing or liner 10.

At the conclusion of the treating of the interval with all the plug assemblies in position in the interval or even before all the plugs to span the interval have been delivered, the removal process can take place that opens the casing or liner 10 in the interval treated in one of several ways. If there is a disappearing barrier that forms the core 24 in each of the plugs the stimulus that makes the cores disappear can be introduced or activated so that all the cores open to production flow. This can preferably be done with introduction of acid for a long exposure so that the cores 24 dissolve or are reacted to a condition where they release from the housing 18 of the plug assembly 16. It can also be done with temperature of wellbore fluids or with a magnetic or other field. It should be noted that as soon as another plug is about to be introduced, the acid or other stimulus can be activated for the plug that will now be covered with a higher landed plug. While the zones are treated with acid, or some other stimulus such as brine or heat for example, the cores 24 remain intact since the duration of the procedure is short enough to maintain the integrity of the cores 24. At the end of the procedure there is more time or the composition of the acid can be altered to induce core failure and the opening up to flow from the interval of all the plug assemblies 16. Other stimuli that can get the same result are envisioned such as thermal, electromagnetic or the introduction of a substance that catalyzes a reaction with the material of the cores 24 to mention some possibilities.

As an alternative to removal of the cores 24 there is also the option of removing all the plug assemblies such as those shown in FIG. 3 by releasing them from their latch locations and either advancing them further into the wellbore or retrieving them either one at a time or preferably by first releasing them from their latch locations and securing them to each other as part of that releasing process and then bringing the collection of all the plugs to the surface. One way to release the plug assemblies is to apply pressure from the surface or through one or more control lines and use a movable sleeve 56 that has a split 57 for each profile such as 12 or 14 that is held in a two step recess by a shear pin or shear ring 25 so that applying pressure will shift the profile on the split sleeve in the recess so that the plug can get past the profile because the stored force in the sleeve allows it to move outward radially into the deeper portion of the recess and land on the next plug below or on the hole bottom. Since each plug assembly is sealed to the inside wall 30 of the casing or liner 10 when retained in a given profile, blowing out a plug by releasing it from the profile simply allows pressure to then be applied to the next plug down and the process is repeated until all the plugs are released and pushed clear of the interval. The downside of this procedure is that the formation gets pressurized as each plug releases from its associated profile and this can adversely affect subsequent production in some cases.

Another alternative is to run a tool into the well that can apply a physical force to the topmost plug to allow it to release from its associated profile while being selectively retained by the string and grapple tool that grips the topmost plug. Once the topmost plug is released the string is lowered so that the lower end of the topmost plug engages and retains the plug below. Weight is again set down and the process is repeated until the string is selectively supporting all the plugs. The assembly of all the plugs can be run to the hole bottom and released or the assembly can be brought to the surface to remove all the plugs from the casing or liner 10 while leaving the profile sleeves in the deeper recess. The profile sleeves can be slit so that moving into the deeper recess allows them to grow in diameter to allow the plugs to pass on the way out of the casing or liner 10, if that option is being used.

For example, in FIG. 3 a string 60 with an overshot 62 can grab the lower portion of the disconnect 34 that is on the topmost plug such as 38. The lower end of plug 38 can have another grip device such as an overshot 64 that grabs the remaining portion of the disconnect 34' on plug 40. As stated before with respect to FIG. 2 the recess 58 can have two depths and the profile 14 can be pinned in the position shown and with the use of a longitudinal split be able to snap into a deeper recess for a release of the grip on the projections such as 20 and 22. In these designs, since the plugs are displaced further into the wellbore or removed there is no need for a removable core such as 24. The removable core 24 opens the path in the casing or liner 10 by leaving in the plug housing 18 secured to a respective profile. The alternative method that takes the entire plug assembly leaves a fully unrestricted opening as the profile has retracted further into an adjacent deeper recess taking it partly or totally out of the pathway through the casing or liner 10.

Those skilled in the art will recognize that the milling out of a series of plugs as was done in the past is not required. The plugs can all be opened up internally such as by removal of a core using a variety of stimuli with the preferred technique being dissolving or reacting away the cores 24 such as using acid pumped into the casing or liner 10 at the conclusion of the fracturing or acidizing or other completion step. Alternatively, the plugs do not need disappearing cores but instead have a mechanism to release from the profile where they are supported. They can collectively be allowed to go to hole bottom or they can be captured to each other and removed all together from the casing or liner 10. Alternatively the plugs can be blown into a released position from the profile that supports them but that approach adds pressure to the formation that in some cases is not advantageous to maximizing production. In yet another approach the plugs can be pulled out one at a time but that process is more time consuming and hence expensive than pulling them all out at once or simply opening a passage through them all in a simple operation that removes their cores.

The above description is illustrative of the preferred embodiment and many modifications may be made by those skilled in the art without departing from the invention whose scope is to be determined from the literal and equivalent scope of the claims below.

We claim:

1. A method of treating an interval defined by a lowermost plug and an uppermost plug of a plurality of plugs in a borehole extending from a surface location to a subterranean location comprising:

delivering a plurality of plugs, which when landed, contact a portion of a casing or liner for sealing therewith, each said plug connected to a respective releasable perforating gun for landing said plugs at respective predetermined profiles in the casing or liner through the interval;

removing a respective gun from each plug with said plug isolating a portion of the casing or liner after the respective said gun is fired and before the next plug is delivered;

treating a portion of the interval defined by the plug previously supporting said respective gun just fired before the next plug is delivered;

opening a passage through the interval in said casing or liner, which extends the length of all the plugs after the interval is treated by nondestructive physical removal of said plugs from the interval.

2. The method of claim 1, comprising:

providing slots on said housing to create flexible fingers having exterior projections for selective engagement with said respective predetermined profile in said casing or liner.

3. The method of claim 2, comprising:

providing a seal on said housing to engage an interior wall of said casing or liner when said exterior projections are supported by said respective predetermined profile in said casing or liner.

4. The method of claim 1, comprising:

using pressure to release said plugs from their respective predetermined profiles;

driving said plugs from the interval with said pressure.

5. The method of claim 1, comprising:

mechanically forcing said plugs from their respective predetermined profiles;

moving said plugs out of the interval.

6. The method of claim 5, comprising:

forcing said plugs further into said casing or liner to get them out of said interval.

7. The method of claim 5, comprising:

picking up said plugs through said casing or liner to get them out of said interval.

8. The method of claim 6, comprising:

moving all said plugs in tandem out of said interval.

9. The method of claim 7, comprising:

moving all said plugs in tandem out of said interval.

10. The method of claim 5, comprising:

securing adjacent plugs together when forcing at least one plug from support at a said predetermined profile.

11. The method of claim 5, comprising:

running in a string with a disconnect adjacent a lower end thereof;

gripping a topmost plug with said disconnect;

driving a second disconnect located on a lower end of the topmost plug to grab another adjacent plug for subsequent release of the adjacent plug with force applied to said string.

12. The method of claim 5, comprising:

providing a sleeve for each plug in said casing or liner to engage a recess in said respective predetermined profile;

movably mounting said sleeve in said recess;

shifting said sleeve to allow a release of said plug.

13. The method of claim 12, comprising:

providing two depths for said recess;

retaining said sleeve in a gripping position in a shallower depth of said recess with a releasable member;

moving said sleeve into a deeper portion of said recess after overcoming said releasable member.

14. The method of claim 13, comprising:

providing a longitudinal split in said sleeve;

allowing said sleeve to move radially into said deeper portion of said recess due to said split and a stored force in said sleeve that is released by said moving.

15. The method of claim 14, comprising:

forcing said plugs further into said casing or liner to get them out of said interval.

16. The method of claim 14, comprising:

picking up said plugs through said casing or liner to get them out of said interval.

* * * * *